US005255477A

United States Patent [19]

Goodspeed

[11] Patent Number: 5,255,477

[45] Date of Patent: Oct. 26, 1993

[54] EASILY CLEANABLE ROOF GUTTERS

[76] Inventor: Byron L. Goodspeed, 203 White Rd., Castle Rock, Wash. 98611

[21] Appl. No.: 753,419

[22] Filed: Aug. 30, 1991

[51] Int. Cl.[5] ..... E04D 13/00

[52] U.S. Cl. ..... 52/11; 248/48.1; 248/48.2

[58] Field of Search ..... 248/48.1, 48.2; 405/119, 121; 52/11

[56] References Cited

U.S. PATENT DOCUMENTS 3,091,055 5/1963 Hegedusich .
3,507,078 4/1970 Sayers, Sr. .
4,199,121 4/1980 Le Febvre .
4,270,572 6/1981 Jarzynka .
4,407,097 10/1983 Allen ..... 52/11
4,413,449 11/1983 Faye .
4,669,232 6/1987 Wyatt .
4,696,131 9/1987 Schreffler .

*Primary Examiner*—Carl D. Friedman
*Assistant Examiner*—Christopher Kent
*Attorney, Agent, or Firm*—Dellett and Walters

[57] ABSTRACT

A system mounting rain gutters end-to-end to a structure enabling cleaning of gutter sections by lowering a first end of a gutter section relative to a second end thereof, the system comprising a substantially U-shaped hinge member with a substantially U-shaped pivotable member connected thereto for pivotably supporting the second end of the gutter section. A wedge-shaped releasable member having a movable plate locked thereto releasably supports the first end of the gutter section.

13 Claims, 4 Drawing Sheets

EASILY CLEANABLE ROOF GUTTERS

BACKGROUND OF THE INVENTION

The present invention relates generally to systems for interconnecting rain gutters to a structure and more particularly to such a system that allows easy access and cleaning of the gutters.

Rain gutters often become clogged with leaves, pine needles, dirt and other debris and therefore require cleaning so that they may function properly to collect rain from a roof of a structure and direct it to a downspout. Since rain gutters are typically mounted high above the ground partially under the eaves of buildings, it is sometimes somewhat dangerous to reach the height necessary to clean the gutters. Accordingly, several prior art gutter mounting systems have been developed which are directed towards the problem of safe and easy access to the gutters. However, certain problems still exist with prior art systems.

A number of prior art mounting systems directed toward easy cleaning of gutters involve "side dumping" mechanisms. That is, these prior art gutter mounting systems have allowed their attached gutters to pivot, generally as if hinged along a longitudinal axis of the gutter proximate the edge of the roof, such that the gutter is inverted, or partially inverted, to dump debris over an outer longitudinally running edge of the gutter or to allow spraying of the trough thereof. Accordingly, the entire length of the gutter remains at substantially the same height in a horizontal cleaning position as it was in its horizontal operating position. One problem with this type of system is that debris, upon being dumped over the edge of the gutter or sprayed out with a hose, is scattered along the length of the gutter in front of the house or building. Debris is not as easily picked up and discarded as would be preferred.

Another problem arises with some systems because caked-on dirt, mud or other material, which will not simply fall out of the gutter upon being inverted, must be washed out with forced water from a hose or cleaned out with one's hand or a tool. This presents a potential problem because the entire gutter is still positioned well above the ground during the cleaning operation whereby one must directly impact the entire area to be cleaned from a considerable distance with a forceful spray, climb a ladder to clean the gutter by hand or manipulate a cleaning tool from the ground to scrape the gutter clean. The inefficiency and potential danger associated with these additionally required cleaning techniques have been, at least in part, the driving force behind the development of easy-to-clean gutter systems in the first place.

Furthermore, with some of the prior art gutter mounting systems, one ordinarily stands underneath or nearly underneath the gutter for inverting the same with a tool or for spraying water into the gutter once it has been inverted. Thus, there is a potential for debris, water or both to come cascading down upon the person cleaning the gutter. This is obviously undesirable from safety and cleanliness standpoints.

Prior gutter mounting systems have not involved the lowering of one end of the gutter to the ground to allow cleaning.

SUMMARY OF THE INVENTION

In accordance with one aspect of the invention, a system for mounting conventional gutters is provided which preferably comprises a hinge member for interconnecting a length of gutter to a structure and a releasable member for interconnecting the rain gutter to the structure such that lowering one end of the gutter relative to another end thereof is permitted.

The ability to lower one end of the gutter relative to another end of the gutter, e.g. as by lowering one end of the gutter to the ground level while the other end remains at the level of the eaves of the structure, has certain advantages over prior art side dumping systems. For example, when one end of the gutter is lowered to the ground, but not inverted, it is relatively easy to spray water into the gutter at any point along the gutter to loosen debris without excessive mess. Moreover, by spraying water into the gutter in a manner to reach the top thereof, water is provided which is then allowed to run in the trough of the gutter from the top to the bottom thereof when the gutter is in the cleaning position. The running of water in this manner along the inner surface of the gutter provides an additional cleaning function which is unavailable when the gutter is merely inverted. That is, when the gutter is merely inverted, the person cleaning the gutter must accurately spray water directly onto each clogged area from a sometimes long distance, and there is not the additional running action of water along the length of the gutter as described above. With the present invention, the person cleaning the gutter may, in addition to allowing the water to run the length of the gutter, still use the direct force of sprayed water directly onto each clogged area. However, such direct spraying is facilitated because a substantial portion of the gutter's length is close to the ground or at least easily reached while standing on the ground. These advantages make gutter cleaning easier and substantially lessen the likelihood that the person cleaning the gutter will need to climb onto a ladder to a precarious height for cleaning the gutter.

A further advantage of lowering one end of the gutter relative to the other for cleaning, as opposed to inverting the gutter, is that, instead of dumping debris on the ground along the length of the gutter to be later picked up and hauled away, debris is directed to a more or less concentrated area, making it easier to collect.

Still another advantage of the present invention over prior systems is that, since the gutter is typically not inverted, the mess and danger associated with debris and water cascading onto the person who is cleaning the gutter from below is avoided. Rather, debris and/or water used to clean the debris runs along the gutter at an angle to the ground to a designated area.

In accordance with another aspect of the invention, members for interconnecting the gutter to the structure are preferably substantially U-shaped in cross section and have gaskets therebetween to form a leak-proof channel between gutter sections when the gutters are in their operational position.

In accordance with yet another aspect of the invention, the gutters may be unlocked for lowering purposes by means of a tool mounted on a pole. Accordingly, a ladder or other means of perching oneself at a precarious height is avoided. Moreover, the ease of release and reattachment of the gutter to the structure is enhanced by a feature of the invention wherein the bracket for releasably interconnecting the gutter to the structure is wedge-shaped to permit easy rotation of the gutter into and out of the bracket.

Still further, a method of cleaning gutters is provided comprising the steps of lowering one end of the gutter relative to an opposite end thereof and cleaning the gutter This method of cleaning gutters is more efficient and mess free than prior art methods. Furthermore, since debris is directed to a relatively concentrated area, a screen may be advantageously positioned angularly with respect to the lowered end of the gutter such that the liquid is discharged through the screen while the debris is easily removed or falls therefrom into a bucket or other retaining device.

Accordingly it is an object of the present invention to provide an improved system for mounting gutters to a structure which facilitates cleaning of the gutters and is directed to overcoming many of the problems encountered with prior art systems.

Another object of the invention is to provide an improved apparatus for mounting gutters which renders them easily cleanable yet efficient in operation.

Still another object of the invention is to provide an efficient method and apparatus for cleaning gutters which is less productive of litter than prior art methods and which is nonetheless capable of operation by one standing on the ground.

The subject matter of the present invention is particularly pointed out and distinctly claimed in the concluding portion of this specification. However, both the organization and method of operation of the invention, together with further advantages and objects thereof, may best be understood by reference to the following description taken in connection with accompanying drawings wherein like reference characters refer to like elements.

DETAILED DESCRIPTION OF THE DRAWINGS

Figure 1:
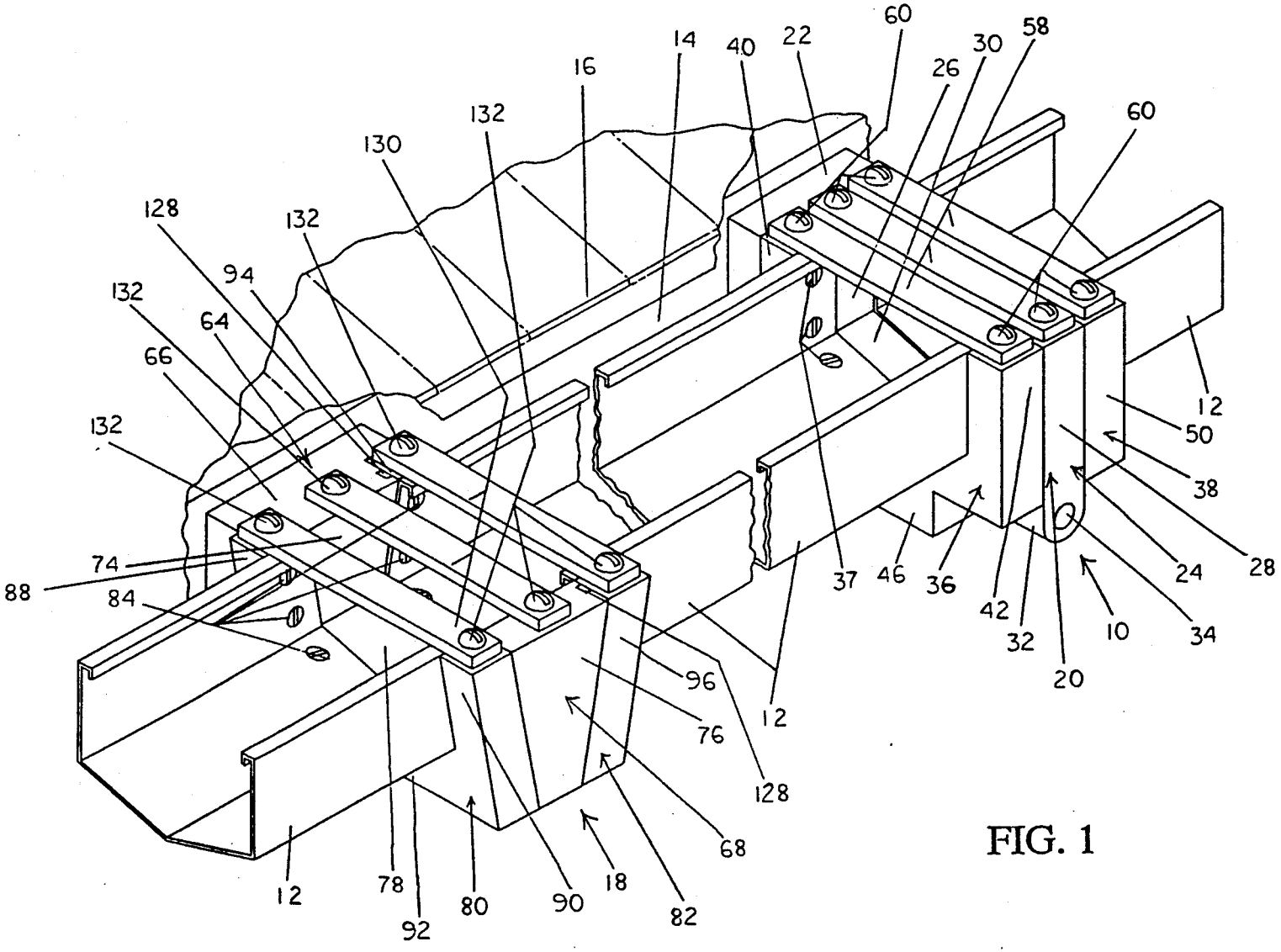
FIG. 1 is a partial perspective view of a gutter mounted to a structure with a gutter support system in accordance with the invention.

Referring to the drawings, a gutter support system in accordance with the present invention is illustrated which generally comprises a bracket member 10 for hingeably attaching one end of a section of rain gutter 12 to the fascia board 14 of a structure and a bracket member 18 for releasably interconnecting the opposite end of the gutter to the fascia board of the structure. As shown in FIG. 1, and as is the case with conventional mounting systems, the gutter support system of the present invention is typically attached to the fascia board 14 of the structure just beneath an overhang 16 on the roof of the structure such that water runs off the roof and into gutter 12.

Figures 2, 3:
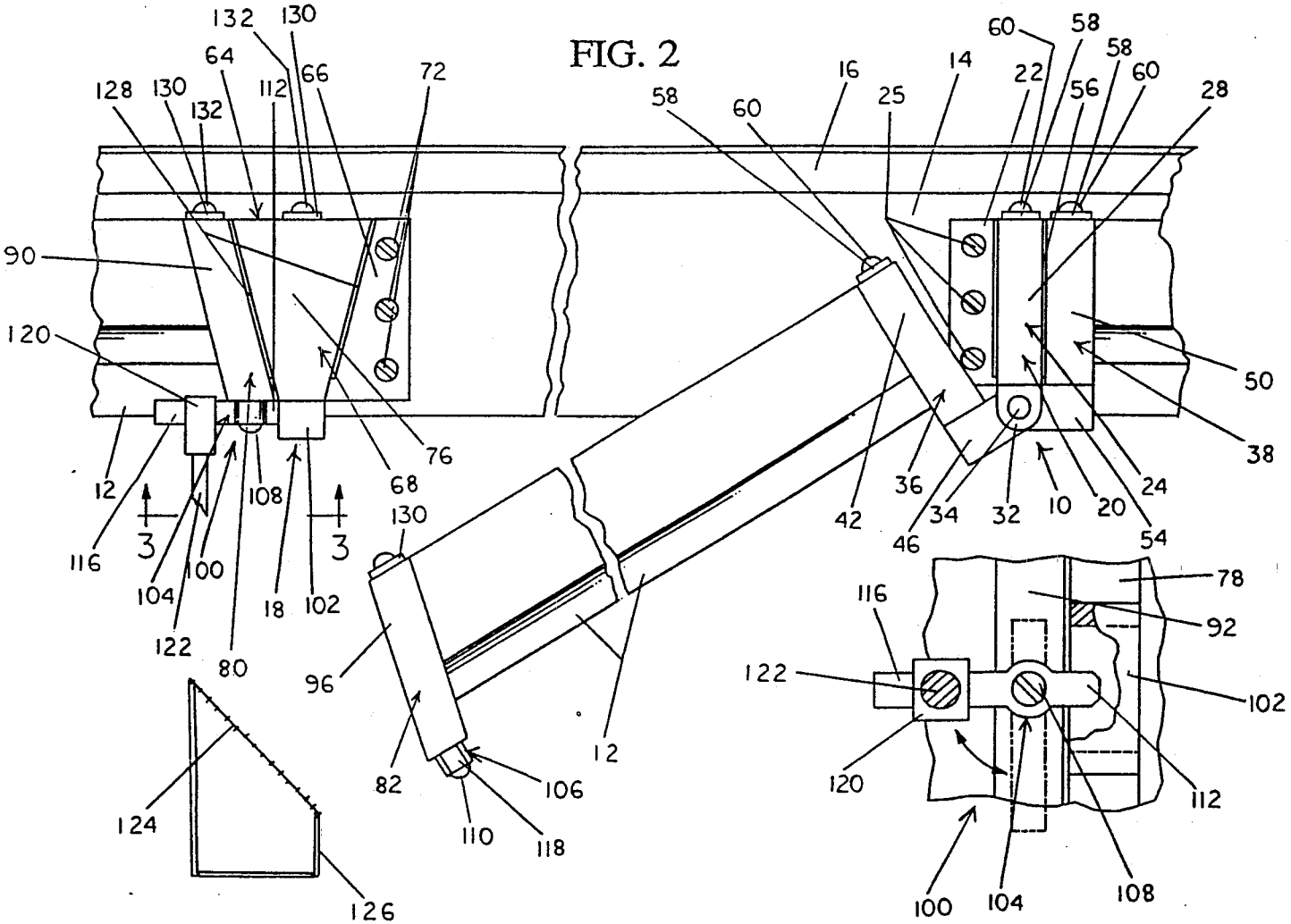
FIG. 2 is a front view of the gutter support system of FIG. 1 wherein a tool has been used to unlock the gutter to allow it to be pivoted to a cleaning position as shown, and wherein a screen employed in a novel method of cleaning gutters is illustrated.
FIG. 3 is a detailed view taken along line 3—3 of FIG. 2 illustrating a lock operable between a first locked position and a second unlocked position shown in phantom dotted lines, wherein a pole supporting the tool for operating the lock is illustrated in cross section, and part of the retaining means is broken away to show the locking arm.
Figure 4:
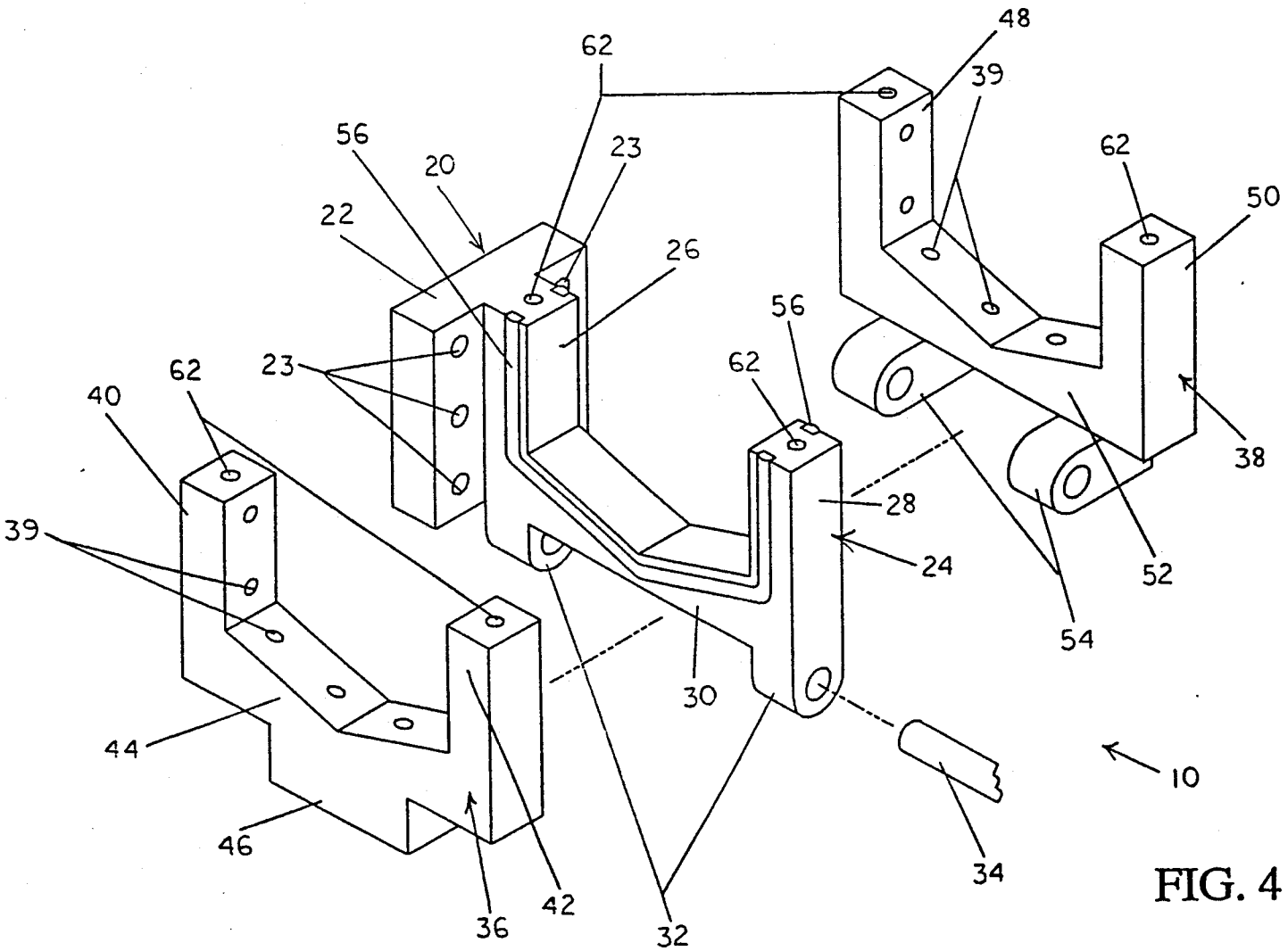
FIG. 4 is an exploded perspective view of a hinged bracket member of the gutter support system of FIGS. 1 and 2.

Perhaps as best seen in FIG. 4, hinged bracket 10 of the gutter support system further comprises a fixed center member 20 having a generally rectangular box-shaped mounting 22 for interconnecting hinged bracket 10 to fascia board 14, the fixed center member having a hinge channel member 24 of generally U-shaped cross section, open endwise longitudinally of the roof line, which is supported integrally from mounting 22. Mounting 22 has a plurality of holes 23 (FIG. 4) for interconnecting the fixed center member 20 to the fascia board 14 of the structure, i.e., employing screws 25 (FIG. 2). The U-shaped cross section of the hinge channel member 24 is formed, preferably integrally, by inner and outer uprights 26, 28 and a slightly V-shaped cross member 30 extending between and interconnecting the uprights at their lower ends. The inner upright 26 interconnects the rest of the hinge channel member 24 to the mounting 22. Preferably integral with, and on the underside of each end of the cross member 30, are hinge members 32 which have holes therethrough running perpendicular to fascia board 14 for receiving a hinge pin 34.

Hinged bracket 10 further comprises a pair of pivotable members 36, 38 which have substantially U-shaped cross sections adapted for mating with channel member 24 and which are for supporting and pivotably interconnecting a pair of gutter sections 12 to channel member 24. That is, each pivotable member 36, 38 is fixedly mounted to the end of a gutter section 12, e.g. by means of flathead screws 37 (FIG. 1) driven through the gutter section and into threaded holes 39 (FIG. 4) in the pivotable members, with the ends of the gutter sections nesting in the U-shaped portions of their corresponding pivotable members. Each pivotable member 36, 38 is hinged to channel member 24 by members 32 such that the channel member is positioned between the adjacent ends of gutter sections 12.

Pivotable member 36 comprises inner and outer uprights 40, 42 and a slightly V-shaped cross member 44 which integrally interconnects the lower ends of the uprights. As in the case of channel member 24, the uprights 40, 42 and cross member 44 form the substantially U-shaped cross section of the pivotable member 36. A single rectangular hinge arm 46 having a curved end extends perpendicularly downwardly and integrally from pivotable member 36 toward fixed center member 20 so as to be positioned between hinge members 32, hinge arm 46 having a bore therethrough which is aligned with the holes in hinges 32 so as to receive hinge pin 34.

Pivotable member 38, which is similar to pivotable member 36, also comprises inner and outer uprights 48, 50 interconnected by a slightly V-shaped cross member 52 to form a substantially U-shaped cross sectional channel corresponding to the U-shaped channel formed by pivotable member 36 and channel member 24. Integral with pivotable member 38 are hinge arms 54 which extend perpendicularly downwardly and toward hinge channel member 24. The holes in hinge arms 54 are arranged in coaxial relation with holes in hinge members 32 and hinge arm 46 in their assembled condition, with hinge arms 54 disposed between each hinge member 32 and hinge arm 46 for receiving hinge pin 34.

In a first operational position of the gutters 12, i.e. when the gutters are aligned end-to-end ready to receive run-off from the roof wherein pivotable members 36, 38 lie in planes substantially parallel to channel member 24, the substantially U-shaped cross sections of the hinge channel member and the pivotable members are aligned to form a channel within which the gutter segments partially lie or nest as described such that the hinge channel member may communicate liquid between two adjacent gutter segments. As can be seen in FIG. 4, U-shaped gaskets 56 are retained in grooves within channel member 24 for providing a seal between hinge channel member and pivotable members 36, 38 when they are in the above described operational position in order to prevent leaking.

Tie rods 58 are suitably attached to and interconnect the tops of uprights 26, 28 of channel member 24, uprights 40, 42 of pivotable member 36, and uprights 48, 50 of pivotable member 38, being secured thereto with screws 60 (FIGS. 1 and 2) driven into holes 62 (FIG. 4) in the tops of the uprights. Tie rods 58 help secure gutter segments 12 within pivotable members 36, 38 and provide additional support for the entire hinged bracket member 10 such that, upon encountering heavy loads of water, dirt, leaves and other debris, the hinged bracket will function as intended.

Figure 5:
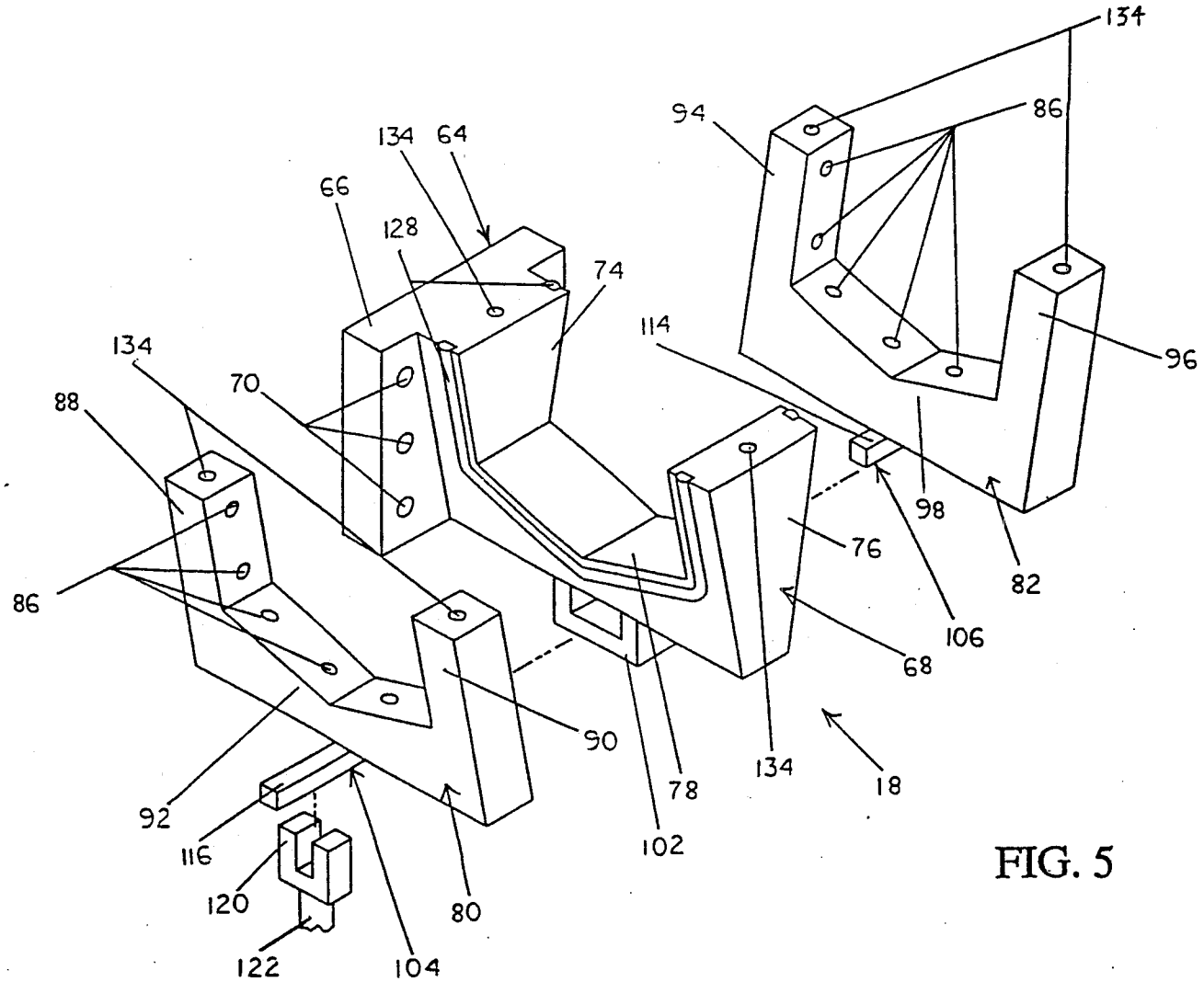
FIG. 5 is an exploded perspective view of a releasable bracket member of the gutter support system of FIGS. 1 and 2, and the tool and lock of FIGS. 2 and 3.

Releasable bracket member 18 further comprises, as can best be seen in FIG. 5, a fixed center member 64 having a rectangular block-like mounting 66 for interconnecting the center member to fascia board 14 by means of screws 72 (FIG. 2) driven through a plurality of holes 70 (FIG. 5) in the mounting just beneath overhang 16 of the roof of the structure. The fixed center member 64 also includes a substantially wedge-shaped channel member 68 extending preferably integrally from mounting 66 and which has a substantially U-shaped cross section open longitudinally of the roof line. The narrower end of wedge-shaped channel member 68 points downwardly toward the ground (i.e., the surfaces of the wedge are inclined together proceeding downwardly along the vertical dimension of the profile of the member). The U-shaped cross section of wedge-shaped channel member 68 is formed, preferably integrally, by inner and outer uprights 74, 76 and a slightly V-shaped cross member 78 between and interconnecting the uprights at their lower ends.

Releasable bracket member 18 further comprises a pair of releasable plates 80, 82 which have matching substantially U-shaped cross sections and which are employed for supporting and releasably interconnecting a pair of gutter sections 12 to wedge-shaped channel member 68. Each releasable plate 80, 82 is mounted at the end of a gutter section 12 with flathead screws 84 (FIG. 1) driven through the gutter section and into holes 86 (FIG. 5) in the plates, the ends of the gutter sections nesting in the U-shaped portions of their corresponding plates.

The U-shaped cross section of releasable plate 80 is formed by inner and outer uprights 88, 90 and slightly V-shaped cross member 92 which interconnects the uprights integrally at their lower ends. Similarly, the U-shaped cross section of releasable plate 82 is made up of inner and outer uprights 94, 96 and slightly V-shaped cross member 98 which integrally interconnects the uprights at their lower ends.

Tie rods 130 (FIG. 1) are attached to and interconnect uprights 74, 76 of wedge-shaped channel member 68, uprights 88, 90 of the releasable plate 80, and uprights 94, 96 of the releasable plate 82 with screws 132 (FIGS. 1 and 2) driven into holes 134 (FIG. 5) in the top of the uprights. Tie rods 130 serve a purpose similar to that of tie rods 58 previously described.

A releasable locking mechanism 100 of the gutter support system is employed for controllably securing the ends of gutter sections 12, as mounted to plates 80, 82, to the channel member 68. See FIGS. 2, 3 and 5. Extending perpendicularly downwardly from cross member 78 of wedge-shaped channel member 68 is an apertured retaining block 102 which forms a part of the releasable locking mechanism. Locking arms 104, 106 are pivotably attached via pins 108, 110 to the underside of respective cross members 92, 98 of plates 80, 82, with the pins being located between inner retainable portions 112, 114 and outer actuable portions 116, 118 of the locking arms. Inner retainable portions 112, 114 are received within the aperture of the retaining block 102 so as to lock the respective releasable plates 80, 82 in the first operational position of the gutter support system and gutters 12 wherein the gutters are substantially aligned end-to-end, and releasable plates 80, 82 are immediately adjacent wedge-shaped channel member 68 such that the U-shaped cross sections of the various members are aligned to allow liquid to flow therethrough from one gutter section 12 to the next. It will be noted that plates 80 and 82 are angularly related to their respective gutter sections in such manner as to align with the sides of the wedge-shaped channel member 68 when the gutter sections are upraised as shown in FIG. 1. As can best be seen in FIG. 5, a pair of substantially U-shaped gaskets 128 are retained in grooves within the surfaces of wedge-shaped channel member 68 facing the releasable plates 80, 82, such that in the first operational position described above, a seal is formed between channel member 68 and plates 80, 82 to prevent leaking of liquid therebetween.

Portions 116, 118 of locking arms 104, 106 are actuable by hand. However, the locking arms are preferably operated by means of a U-shaped tool 120 fixed on the end of a pole 122 and usable by a person on the ground. The tool is capable of engaging either of the actuable portions for pivoting the locking arms from their locked position to an unlocked position wherein the retainable portions 112, 114 no longer extend within retaining block 102, whereby the ends of the gutter sections mounted to releasable plates 80, 82 can be lowered toward the ground to a cleaning position as shown in FIG. 2. In other words, in the unlocked position, retainable portions 112, 114 are free of retaining block 102 to allow the ends of gutter sections 12 mounted in plates 80, 82 to pivot downwardly toward the cleaning position. The ends of the gutter sections mounted to pivotable members 36, 38 remain substantially at the level of fascia board 14 while pivoting about pin 34 whereby the ends of the gutter sections mounted to the releasable plates can be positioned at or just above the level of the ground. In this cleaning position of gutters 12, pivotable members 36, 38 form an angle relative to the channel member 24 (e.g. as shown between pivotable member 36 and channel member 24 in FIG. 2). In such cleaning position, the person cleaning the gutters may spray water up and into the gutter with a hose and allow the water to wash down the inclined gutter to thereby wash out dirt, leaves and other debris. Furthermore, while standing on the ground, the person cleaning the gutter can reach a substantial length of the gutter section to clean out obstructions by hand, or he or she can reach the entire length with a hand held tool.

The downwardly pointing, wedge-shape of channel member 68 facilitates the pivoting of releasable plates 80, 82 downwardly and away from the channel member 68 without hang up, and likewise the pivoting of the releasable plates upwardly and into contact with the channel member after cleaning. Hinged bracket member 10 and releasable member 18 may be cast or otherwise formed, preferably of metal.

As necessary to accommodate the length of eaves 16 of the structure, several lengths of gutter 12 according to the present invention may be interconnected to the structure, the gutter lengths being interconnected end-to-end in communicating relation by a plurality of hinged brackets 10 and releasable brackets 18. At the end of fascia board 14 of the structure, a single sided hinged bracket 10 or releasable bracket 18 (i.e., a hinged bracket with a single pivotable member hinged thereto or a releasable member with a single releasable plate) may be employed. In such case, the gutter section is provided with a conventional end wall at the pivotable member or releasable plate or in the adjoining channel member. Alternatively, the gutters may be extended by short straight sections of gutter at these locations, which sections are mounted to the fascia board and provided with downspouts as desired.

The method of operation according to the present invention is practiced by a person on the ground who lowers an end of the gutter by employing tool 120 on pole 122 to unlock a gutter section. Once the gutter is lowered to the cleaning position, the method comprises spraying water into the gutter and allowing the water to run down the inclination and through a wire mesh 124 or other screen mounted on a stand 126 to trap debris and allow water to flow on through. The screen is suitably tilted at an angle as shown in FIG. 2 to allow the debris to fall off the screen to the ground or into a container, and to facilitate the cleaning of the screen. Such screen is also suitably employed under downspouts.

It is understood that various modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all patentable features that reside in the present invention, including all features that would be treated as equivalents thereof by those skilled in the art to which the invention pertains.

I claim:

1. A rain gutter support in combination with a water collecting elongated gutter member supported by said rain gutter support on a structure, said gutter member having first and second ends separated longitudinally along said gutter member from one another, said gutter member being trough-shaped in cross section for enabling passage of water therealong, said rain gutter support comprising:

a hinge member connecting said first end of said through-shaped gutter member to said structure in pivoting relation to said structure such that said second end of said gutter member may be lowered with respect to said first end for directing flow of contents of said gutter member downwardly along said gutter member, and a releasable member located at said second end of said trough-shaped gutter member adapted to releasably interconnect said second end of said gutter member and said structure to enable pivoting of said gutter member about said hinge member when said gutter member is released.

2. The rain gutter support of claim 1 wherein said hinge member comprises a fixed member attached to said structure and a pivotable member hinged to said fixed member, said pivotable member for being adapted for mounting said first end of said gutter member, said fixed and pivotable members being hinged together about an axis perpendicular to the longitudinal axis of said gutter member such that said pivotable member is rotatable with respect to said fixed member.

3. The rain gutter support of claim 2 wherein said fixed member comprises a center member that is of generally U-shaped cross section, and further comprising a second pivotable member, said second pivotable member being of generally U-shaped cross section and adapted for mounting to a second gutter member, said second pivotable member being hingeably attached to said fixed member about an axis perpendicular to the longitudinal axis of said second gutter member such that said fixed member is located between said pivotable members to allow said pivotable members to rotate with respect to said fixed member.

4. The rain gutter support of claim 3 wherein generally U-shaped cross sections of said fixed and pivotable members are aligned to form a channel when said fixed and pivotable members are in a position where each said pivotable member is closely adjacent said fixed member.

5. The rain gutter support of claim 4 further comprising at least one gasket retained in said fixed member for providing a seal between said fixed and pivotable members when said fixed and pivotable members are in the last mentioned position.

6. The rain gutter support of claim 1 wherein said releasable member further comprises a fixed member and a movable member, said fixed member being adapted for mounting to said structure, said movable member being of generally U-shaped cross section and adapted for mounting to the second end of said gutter member, said fixed and movable members being releasably locked together.

7. The rain gutter support of claim 6 wherein said fixed member comprises a center member of generally U-shaped cross section, and further comprising a second movable member of generally U-shaped cross section and adapted for mounting to a second gutter member wherein said fixed and movable members are releasably locked together, said fixed member being located between said movable members.

8. The rain gutter support of claim 7 wherein said fixed member has the shape of a downwardly pointing truncated wedge, and wherein said movable members are releasably locked into a position immediately adjacent inclined surfaces of said fixed member.

9. The rain gutter support of claim 8 wherein said U-shaped cross sections of said fixed and movable members are aligned to form a channel when said fixed and movable members are in said locked position.

10. The rain gutter support of claim 9 further comprising at least one gasket retained in said fixed member for providing seals between said fixed and movable members when said releasable members are in said locked position.

11. The rain gutter support of claim 7 wherein said movable members are adapted for being unlocked for lowering of said gutter members in response to operation of a tool mounted on a pole which may be held by a person standing on the ground.

12. A rain gutter support in combination with a water collecting elongated gutter member supported by said rain gutter support on a structure, said gutter member having first and second ends separated longitudinally along said gutter member from one another, said gutter member being trough-shaped in cross section for enabling passage off water therealong, said rain gutter support comprising:

a pivotable attachment interconnecting said gutter member and said structure for allowing pivoting of said gutter member such that said second end of said gutter member may be lowered with respect to said first end for directing flow of contents of said gutter member downwardly along said gutter member; and a releasable member located at said second end of said gutter member for releasably interconnecting said gutter member to said structure at a distance along said gutter member from said pivotable attachment.

13. A rain gutter support in combination with water collecting elongated gutter members supported by said rain gutter support on a structure, said gutter members having first and second ends longitudinally separated on said gutter members, said gutter support comprising:

a hinge member of substantially U-shaped cross section and having a plurality of pivotable members with substantially U-shaped cross sections hinged thereto, said pivotable members being mounted to first ends of said gutter members, said hinge member interconnecting said pivotable members and gutter members mounted to said pivotable members to said structure such that second ends of said gutter members are permitted to be lowered relative to said first ends of said gutter members attached to said pivotable members, said U-shaped cross sections of said hinge member and said pivotable members communicating to form a channel between said gutter members mounted to said pivotable members when said pivotable members are rotated to a position substantially adjacent said hinge member; and a plurality of wedge-shaped members each having at least one movable plate mating therewith for releasably interconnecting a second end of a said gutter member with said structure at a distance spaced from said hinge member, a said wedge-shaped member and the movable plate associated therewith having substantially U-shaped cross sections such that, when unreleased from said wedge-shaped member, said U-shaped cross section of said movable plate communicates with said U-shaped cross section of said wedge-shaped member, said movable plate being releasable from said wedge-shaped member by means of a tool operable from the ground.

* * * * *